United States Patent [19]

Yu et al.

[11] 4,246,219

[45] Jan. 20, 1981

[54] MULTISEGMENTED FILAMENT SPINNING PROCESS

[75] Inventors: Jing-peir Yu; James E. Bromley, both of Pensacola, Fla.

[73] Assignee: Monsanto Company, St. Louis, Mo.

[21] Appl. No.: 24,350

[22] Filed: Mar. 27, 1979

[51] Int. Cl.[3] ..... B29F 3/10

[52] U.S. Cl. ..... 264/171; 264/177 F; 428/374

[58] Field of Search ..... 264/171, 177 F; 428/374

[56] References Cited

U.S. PATENT DOCUMENTS

| | | | |
|---|---|---|---|
| 3,540,080 | 11/1970 | Goossens | 264/171 |
| 3,725,192 | 4/1973 | Ando et al. | 264/171 |
| 3,802,177 | 4/1974 | Sakiguchi et al. | 264/171 |
| 4,051,287 | 9/1977 | Hayashi et al. | 428/91 |

FOREIGN PATENT DOCUMENTS

| | | | |
|---|---|---|---|
| 61839 | 5/1968 | Fed. Rep. of Germany | 264/177 F |
| 47-37207 | 9/1972 | Japan | 264/177 F |
| 162131 | 6/1933 | Switzerland | 425/464 |

*Primary Examiner*—Jay H. Woo

*Attorney, Agent, or Firm*—Kelly O. Corley

[57] ABSTRACT

In spinning, the orifice is in the form of a slot meandering back and forth across the interface between two conjugated polymers flowing through the orifice.

6 Claims, 1 Drawing Figure

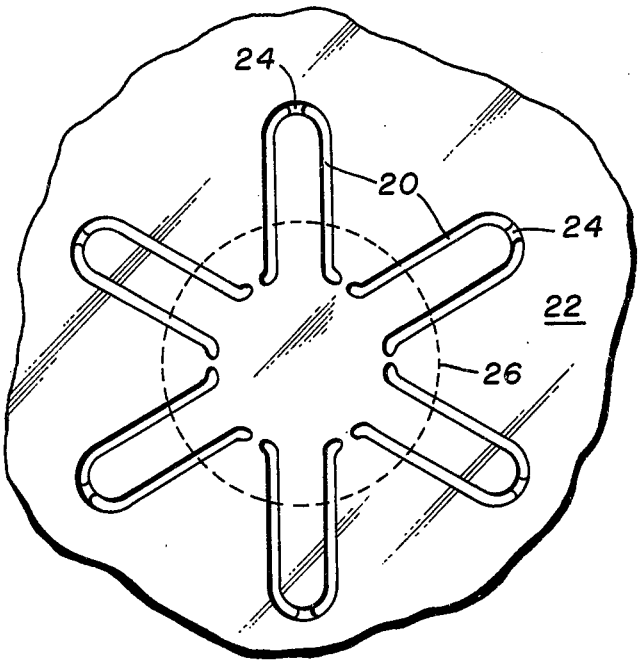
24
20
24
22
26

MULTISEGMENTED FILAMENT SPINNING PROCESS

The invention relates to the art of spinning conjugate filaments having at least two interfaces between different polymers.

It has long been known to spin conjugate filaments having a single interface between different polymeric components. Conjugate filaments having a plurality of interfaces between different polymeric components are likewise known, as typified by Hayashi U.S. Pat. No. 4,051,287, the disclosure of which is incorporated herein by reference. As disclosed therein, alternating segments of polyamide and polyester are spun in side-by-side adhering relationship to form a hollow filament. The Hayashi spinning process involves forming a large number of separate polymer interfaces prior to the spinneret orifice, which entails a considerable complexity in the conjugation plates prior to the spinneret itself.

According to the present invention, the conjugation plates upstream of the spinneret can be considerably simplified by appropriate design of the spinneret orifice.

According to a major aspect of the invention, there is provided a spinning process for producing a spun stream comprising a plurality of separate spun interfaces from a given single interface between different polymers in a supply stream, the given interface extending generally parallel to the direction of the supply stream, the process comprising: passing the supply stream through a spinneret orifice, the orifice being effectively in the form of an elongated slot, the cross-sectional shape of the orifice and the cross-sectional shape of the given interface being selected and located with respect to one another such that a first portion of the given interface passes through and extends transversely across the width of the slot at a first location along the length of the slot, and a second portion of the given interface passes through and extends transversely across the width of the slot at a second location along the length of the slot; and solidifying the spun stream issuing from the slot.

According to another aspect of the invention, the polymers in the supply stream are in sheath-core relationship.

According to another aspect of the invention, the slot meanders back and forth across the interface.

According to another aspect of the invention, the polymer forming the core has lower viscosity than the polymer forming the sheath.

According to another aspect of the invention, the polymers are dissimilar.

Other aspects of the invention will in part appear hereinafter and will in part be obvious from the following detailed description taken in connection with the accompanying drawing in which:

The single FIGURE is a bottom plan view (looking up) of the preferred spinneret orifice used in practicing the invention.

As shown in the FIGURE, the preferred spinneret construction includes several generally arched or horseshoe-shaped slots 20 in spinneret blank 22 arranged symmetrically about a central point, the open ends of the horseshoe shape facing inwardly. The several slots 20 constitute a combined orifice for spinning a single filament. Slots 20 extend entirely through blank 22 except for a recessed web region 24 at the apex of each slot 20. The two different polymers are fed to the combined orifice as a sheath-core supply stream, with dotted circle 26 representing the interface between the two polymers. The adjacent ends of adjacent slots 20 are sufficiently close that the streams issuing therefrom units just below the spinneret. The molten spun stream is thus a hollow structure composed of alternating axially extending segments of the two polymers. Surface tension and other effects tend to make the molten spun stream approach a hollow circular cross-section prior to solidification, substantially as shown in Hayashi FIG. 1.

The spinning process thus produces a spun stream comprising a plurality of separate spun interfaces from the single sheath-core interface between the different polymers in the supply stream, the sheath-core supply interface extending generally parallel to the direction of the supply stream. This is accomplished in this embodiment by passing the supply stream through a spinneret orifice having the form of an elongated slot. The cross-sectional shape of the orifice and the cross-sectional shape of the supply interface are selected and located with respect to one another such that a first portion of the supply interface passes through and extends transversely across the width of the slot at a first location along the length of the slot, and a second portion of the supply interface passes through and extends transversely across the width of the slot at a second location along the length of the slot.

As disclosed specifically above, the several individual slots 20 are so nearly spaced as to be effectively in the form of a single continuous slot. Webs 24 and the lands between adjacent ends of adjacent slots 20 are provided merely to support and retain the metal in the center of the combined orifice. Accordingly the elongated slot contemplated by the invention can be either a continuous single slot, or in the form of an interrupted slot provided that the land between adjacent slot portions is sufficiently narrow that the separate streams merge before solidification. Each individual slot 20 provices for a spun sub-stream having two interfaces, and the illustrated combined orifice provides a combined spun stream having 12 interfaces between different polymeric components.

EXAMPLE I

Nylon 66 polymer and polyethylene terephthalate polymer, each of normal molecular weight for apparel end uses, are extruded at a temperature of 290° C. through the combined orifice, the nylon polymer being the core of the sheath-core stream approaching the combined orifice. Equal volumes of the two polymers are supplied, with the extrusion rate selected to produce a conjugate filament having a denier of 19.5 at a spinning speed of 1500 yards (about 1350 meters) per minute. A quench zone just beneath the spinneret and 1½ meters in height is supplied with quenching air at 20° C., the air being directed horizontally onto the polymer stream and having a speed of 25 meters per minute. Below the quench zone, steam is applied to the filament, a conventional finish is applied, and the filament is wound.

The spun filament is then drawn at 65 meters per minute and at a draw ratio of 2.16 over a contact heater at 132° C., the heater being 0.4 meters long. The resulting drawn yarn, when mechanically worked to break the conjugate filament into 12 sub-filaments, develops substantial torqueless helical crimp when subjected to boiling water.

EXAMPLE II

Seventeen of the above spun filaments are spun simultaneously and collected as a multifilament yarn under the spinning conditions of Example I. The spun yarn is then draw-textured at 540 meters per minute over a two meter heater set at 220°. The resulting textured yarn, when separated into sub-filaments and relaxed, is very voluminous and has high covering power.

EXAMPLE III

Example I is repeated, except that the spinning speed is increased to 4500 meters per minute while the denier of the conjugate filament is reduced to 4. The resulting sub-filaments, after separation and immersion in boiling water, form a highly voluminous and lofty yarn. Fabrics formed from the conjugate yarn acquire a very soft hand and increased bulk and covering power when the fabric is mechanically worked enough to separate the yarn into sub-filaments. Simple exposure of the fabric to boiling water is adequate in many instances, since the flexing of the yarn involved in certain fabric formations separates the sub-filaments.

In the above examples, the nylon 66 has a lower viscosity than the polyethylene terephthalate. The nylon will accordingly flow faster through the slot and acquire higher momentum, and upon exiting will tend to make the approximately star-shaped spun stream more rapidly approach the hollow circular shape which was desired in this particular instance.

In the above examples, nylon-66 and polyethylene terephthalate constitute dissimilar (as well as different) polymers. By "dissimilar" is meant that the polymeric components in the solidified filaments can be readily separated into sub-filaments.

What is claimed is:

1. A spinning process for producing a spun stream comprising a plurality of separate spun interfaces from a given single interface between different polymers in a supply stream, said given interface extending generally parallel to the direction of said supply stream, said process comprising:

a. passing said supply stream through a spinneret orifice, said orifice being effectively in the form of an elongated slot, the cross-sectional shape of said orifice and the cross-sectional shape of said given interface being selected and located with respect to one another such that a first portion of said given interface passes through and extends transversely across the width of said slot at a first location along the length of said slot, and a second portion of said given interface passes through and extends transversely across the width of said slot at a second location along the length of said slot; and b. solidifying said spun stream issuing from said slot.

2. The process defined in claim 1, wherein said slot meanders back and fourth across said interface.

3. The process defined in claim 1, wherein said polymers in said supply stream are in sheath-core relationship.

4. The process defined in claim 3, wherein said slot meanders back and forth across said interface.

5. The process defined in claim 3, wherein said polymer forming said core has lower viscosity than said polymer forming said sheath.

6. The process defined in any of claims 1–5, wherein said polymers are dissimilar.

* * * * *

UNITED STATES PATENT AND TRADEMARK OFFICE

CERTIFICATE OF CORRECTION

PATENT NO. : 4,246,219

DATED : January 20, 1981

INVENTOR(S) : Jing-peir Yu et al

It is certified that error appears in the above-identified patent and that said Letters Patent are hereby corrected as shown below:

Column 2, line 5, "units" should read --unite--.

Column 2, line 39, "provices" should read --provides--.

Signed and Sealed this

*Seventh* Day of *April 1981*

[SEAL]

*Attest:*

RENE D. TEGTMEYER

*Attesting Officer*

*Acting Commissioner of Patents and Trademarks*